US006997598B2

(12) United States Patent
Ding

(10) Patent No.: US 6,997,598 B2
(45) Date of Patent: Feb. 14, 2006

(54) IMPACT-TYPE ROTARY FINING, HOMOGENIZING AND EMULSIFYING DEVICE

(76) Inventor: Nan Ding, Yao Gang Lu Fu 31 Hao 3-208, Nan Tong City, Jang Su (CN) 226006

( * ) Notice: Subject to any disclaimer, the term of this patent is extended or adjusted under 35 U.S.C. 154(b) by 203 days.

(21) Appl. No.: 10/422,775

(22) Filed: Apr. 25, 2003

(65) Prior Publication Data

US 2003/0202421 A1 Oct. 30, 2003

(30) Foreign Application Priority Data

Apr. 26, 2002 (CN) ..... 02112974 A

(51) Int. Cl.
*B01F 5/12* (2006.01)

(52) U.S. Cl. ..... 366/164.6; 366/264; 366/296; 366/317

(58) Field of Classification Search ..... 366/131, 366/164.6, 295, 296, 317, 264; 241/185.6, 241/186.5, 188.1, 188.2, 189.1, 243
See application file for complete search history.

(56) References Cited

U.S. PATENT DOCUMENTS 6,902 A * 11/1849 Learned et al. ..... 241/56
53,912 A * 4/1866 Whitcomb ..... 366/296
90,758 A * 6/1869 Leach ..... 366/296
614,522 A * 11/1898 Whiting et al. ..... 366/246
894,753 A * 7/1908 Smith ..... 261/88
1,947,953 A * 2/1934 Otto ..... 241/188.2
1,970,330 A * 8/1934 Mason ..... 241/21
2,075,506 A * 3/1937 Crites et al. ..... 241/47
2,113,040 A * 4/1938 Anderson ..... 241/252
2,502,022 A * 3/1950 Paul ..... 241/163
2,619,330 A * 11/1952 Willems ..... 366/263
4,883,363 A * 11/1989 Pillon et al. ..... 366/157.4

* cited by examiner

*Primary Examiner*—David Sorkin
(74) *Attorney, Agent, or Firm*—Paul A. Guss

(57) ABSTRACT

An impact-type rotary fining, homogenizing and emulsifying device is constituted by a casing body disposed on a base, a feed port and a discharge port disposed in the casing body, and a power shaft disposed inside of the casing body. The power shaft is equipped with rotary impellers in such a manner that the rotary impellers are disposed on the power shaft and include a first rotary impeller rotated in a positive direction and a second rotary impeller rotated in negative direction. A power shaft portion is located in the feed port and is equipped with a feed impeller. A valuable advantage is obtained in that its new and distinct structure and innovative design enable the device to heighten the impact velocity applied to treated materials many fold, without raising the rotating speed of the impellers. Functions of fining, homogenizing and emulsifying are improved, while effectively enhancing the overall performance of the apparatus, within the motor's allowable rotational speed.

14 Claims, 4 Drawing Sheets

IMPACT-TYPE ROTARY FINING, HOMOGENIZING AND EMULSIFYING DEVICE

BACKGROUND OF THE INVENTION

1. Field of the Invention

The present invention relates to physical methods and techniques of mixing, fining, homogenizing and emulsifying using a device, and to a machine for mixing, fining, homogenizing and emulsifying. More specifically, the invention is directed to an impact-type rotary fining, homogenizing and emulsifying device.

2. Description of the Related Art

Impact-type rotary fining, homogenizing and emulsifying machines are known, which are made up of fining, homogenizing and emulsifying parts and machinery, and have been widely used industrially over a long period of time. All current machines have at least one fixed disk and rotational impellers, which are staggered with respect to each other in the radial direction on a common axis. In order to improve the performance of such machines in conducting fining, homogenizing and emulsifying, in addition to increasing the rotating speed or diameters of the impellers, a lot of research has been expended investigating the shapes of the impellers and the blades used thereon. For example, among such efforts, attempts have been made to reduce the gap between the fixed disk and the rotational impellers, decrease the width of the notches formed between blades, to increase the number of disks and/or impellers used, or to increase the number of blades used on the impellers. Although increasing the rotating speed of the impellers to quicken impact applied to treated materials by the impellers is one effective means of achieving a desired result, raising the rotating speed of the impellers is limited by the motor's allowable rotating speed. Motors with higher rotational speeds disadvantageously add to the total weight and bulkiness of the device.

SUMMARY OF THE INVENTION

An object of the present invention is to provide an impact-type rotary fining, homogenizing and emulsifying device which can raise and increase many fold the impact velocity applied to treated materials, without requiring any increase in the rotating speed of the impellers.

To solve and attain the above object, the present invention is constituted by an impact-type rotary fining, homogenizing and emulsifying device, comprising a casing body positioned on a base, a feed port and a discharge port positioned in the casing body, and a power shaft disposed inside the casing body equipped with rotary impellers. The rotary impellers attached to the power shaft include a first rotary impeller rotated in a positive direction and a second rotary impeller rotated in a negative direction. A power shaft portion is located in the feed port and is equipped with a feed impeller.

According to the present invention, the power shaft equipped with impellers rotated in positive and negative directions is composed of a hollow power shaft member and a solid power shaft member located inside the hollow power shaft member. The first rotary impeller rotated in the positive direction and the second rotary impeller rotated in the negative direction are installed on or attached respectively to the hollow power shaft member and the solid power shaft member. The number of impellers used for each of the first and second rotary impellers is one at least, and the impellers having different rotary directions are staggered radially with respect to each other on the same axis.

In case there are at least two for each of the rotary impellers, the first rotary impeller rotated in the positive direction and the second rotary impeller rotated in the negative direction may be made of an integrated structure, or from a plurality of individual blade elements which are joined together, to provide a multi-blade impeller structure. As discussed above, a centrifugal pump impeller may be used as the feed impeller.

The valuable effect of this invention is that a novel and distinct structure, based on a clever design, is provided to heighten the impact velocity applied to treated materials many fold, without requiring any increase in the rotating speed of the impellers, to thereby improve the functions of fining, homogenizing and emulsifying. Thus, restraints on the device's overall performance, resulting from limits on the allowable rotational speed of the motor, can be overcome.

DETAILED DESCRIPTION OF THE PREFERRED EMBODIMENTS

Figure 1:
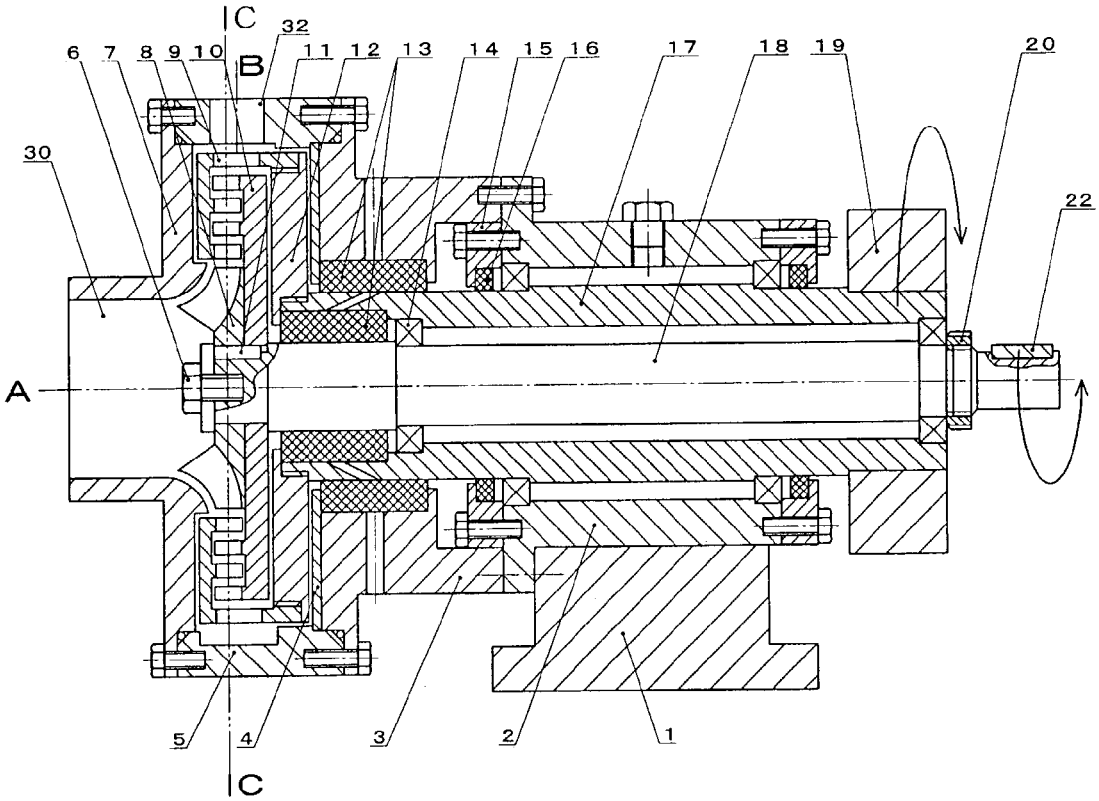
FIG. 1 is a structural drawing of an impact-type rotary fining, homogenizing and emulsifying device according to the present invention.

As shown in FIG. 1, the present invention includes a base or pedestal 1 which supports a bearing box 2, a seal casing 3, a sealing plate 4, a body 5 for encasing the emulsifying machine, a bolt 6, and a casing body 7 attached to the front of the fining, homogenizing and emulsifying device.

The internal components of the device include a centrifugal pump impeller 8, a first rotary impeller 9 rotated in a positive direction, a second rotary impeller 10 rotated in a negative direction, a key 11, a base plate 12 for supporting the first rotary impeller 9 rotated in the negative direction, a machine seal or seal packing 13, a bearing 14 and bearing platen 15, and an oil seal 16. The power shaft mechanism comprises a hollow power shaft member 17, and a solid power shaft member 18 disposed inside the hollow power shaft member 17. Pulleys or gears 19 and 22 are attached respectively to the power shaft members 17 and 18 at the back of the apparatus, along with a nut 20.

The impact-type rotary fining, homogenizing and emulsifying device of the present invention is basically constructed as described above. The specific manner of operation of the device shall now be described.

Figure 2:
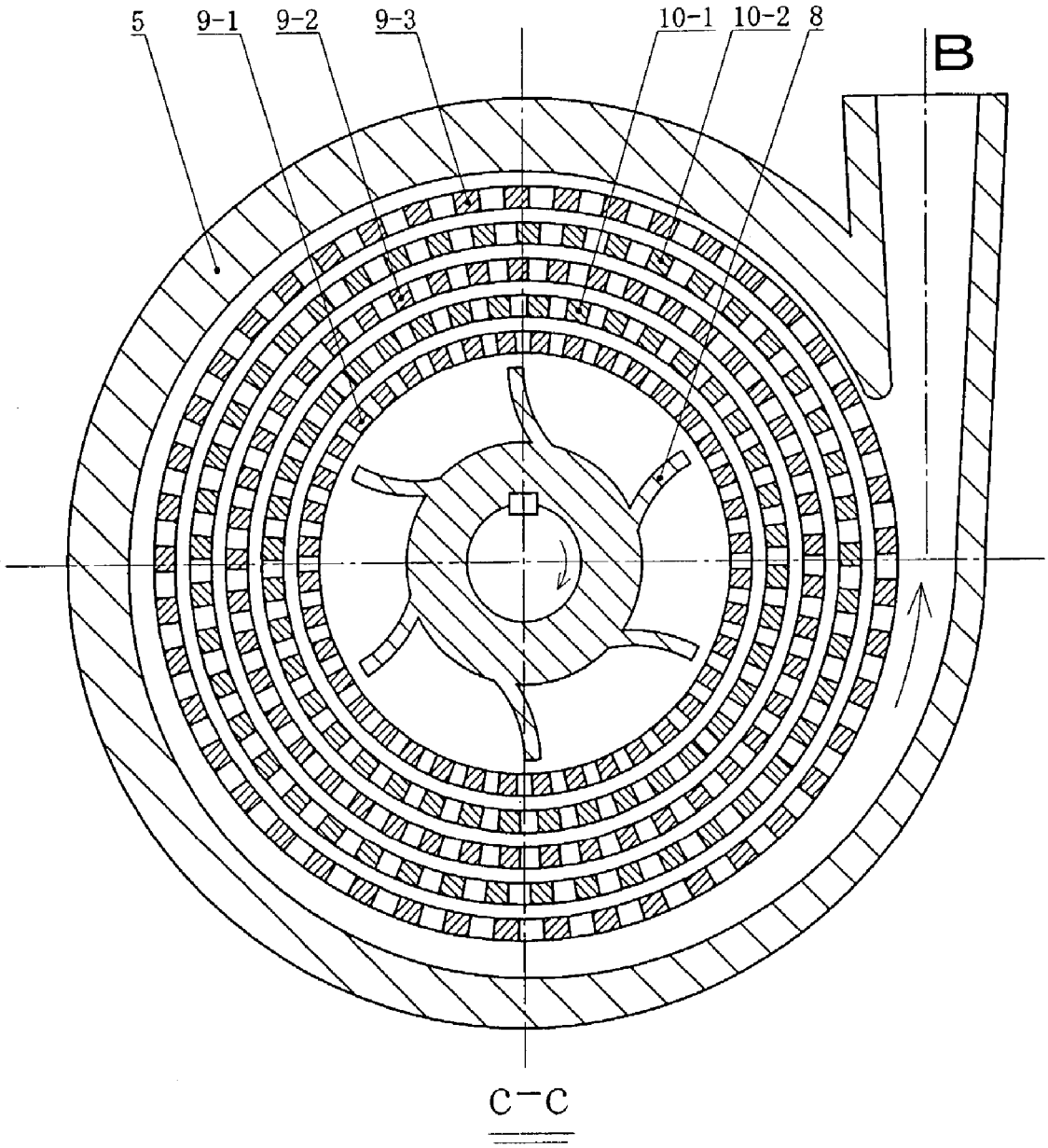
FIG. 2 is a sectional view taken along the line C—C in FIG. 1.

FIGS. 1 and 2 illustrate an exemplary embodiment of the present invention. The first rotary impeller 9 which is rotated in a positive direction and the second rotary impeller 10 which is rotated in a negative direction may each be constructed as an integrated structure. A casing body is positioned on the base 1, and a feed port 30 and a discharge port 32 are disposed in the casing body. A power shaft composed of a hollow power shaft member 17 and a solid power shaft member 18 is rotatably disposed inside the casing body and is equipped with the rotary impellers 9 and 10.

Such rotary impellers are different from those used in the conventional technique in that the rotary impellers located on the power shaft include a first rotary impeller 9 rotated in the positive direction and a second rotary impeller 10 rotated in the negative direction. More specifically, the first rotary impeller 9 is constructed from a plurality of impeller blade members 9-1, 9-2, 9-3, etc., as shown in detail in FIGS. 2 through 4. Similarly, the second rotary impeller 10 is constructed from a plurality of impeller blades members 10-1, 10-2, etc., shown in detail in FIGS. 2 through 4.

A power shaft portion 18 is located in the feed port 32 and is equipped with a feed impeller 8. Further, the power shaft, which is equipped with the first rotary impeller 9 rotated in the positive direction and the second rotary impeller 10 rotated in the negative direction, is composed of a hollow power shaft member 17 and a solid power shaft member 18 positioned inside the hollow power shaft member 17.

The first rotary impeller 9 rotated in the positive direction and the second rotary impeller 10 rotated in the negative direction are respectively installed on or attached to the hollow power shaft member 17 and the solid power shaft member 18. The number for each of the impellers is at least one, wherein the impellers 9 and 10 have different or opposite rotary directions and are staggered with respect to each other in the radial direction on a common axis.

In the case that there are at least two (i.e., more than one) for each of the rotary impellers, the first rotary impeller 9 rotated in the positive direction and the second rotary impeller 10 rotated in the negative direction are each made up of impeller blade members having an integrated or split structure. A centrifugal pump impeller is used as the feed impeller 8.

Figure 4:
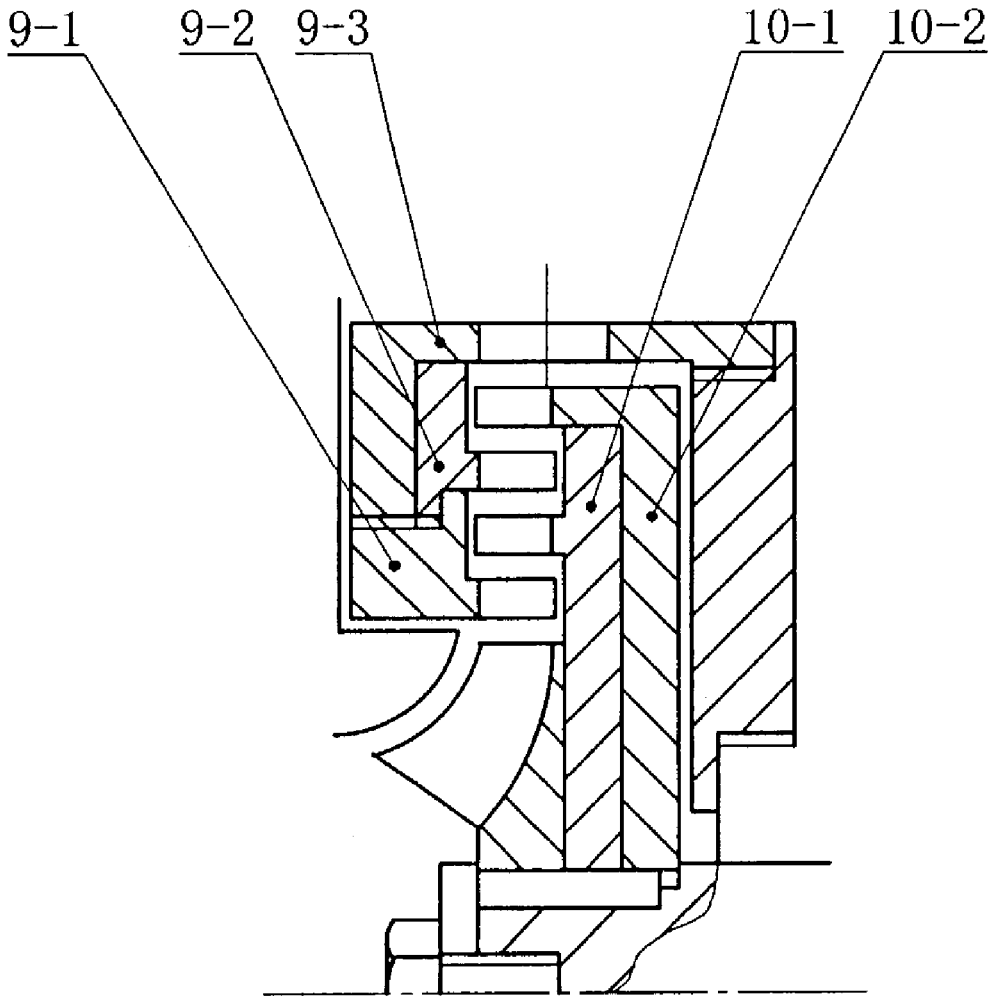
FIG. 4 is an enlarged view of structural details of the impellers which are rotated in positive and negative directions according to the present invention.

FIG. 4 shows in detail the split structure used for each of the first rotary impeller 9 rotated in the positive direction and the second rotary impeller 10 rotated in the negative direction. More specifically, as shown in the figure, the first rotary impeller 9 is composed of respective impeller blade members 9-1, 9-2 and 9-3 which are separately formed but joined together to provide a plurality of impeller blades. Similarly, the second rotary impeller 10 is composed of respective impeller blade members 10-1 and 10-2, which are separately formed but joined together to provide a plurality of impeller blades. As noted previously, it is also possible for the first and second rotary impellers 9 and 10 to be formed as an integrated structure, rather than from a plurality of separately joined impeller blade members.

In summary, the fundamental operating principals of the present invention are as follows, as illustrated in the explanatory drawing shown by FIG. 3.

Figure 3:
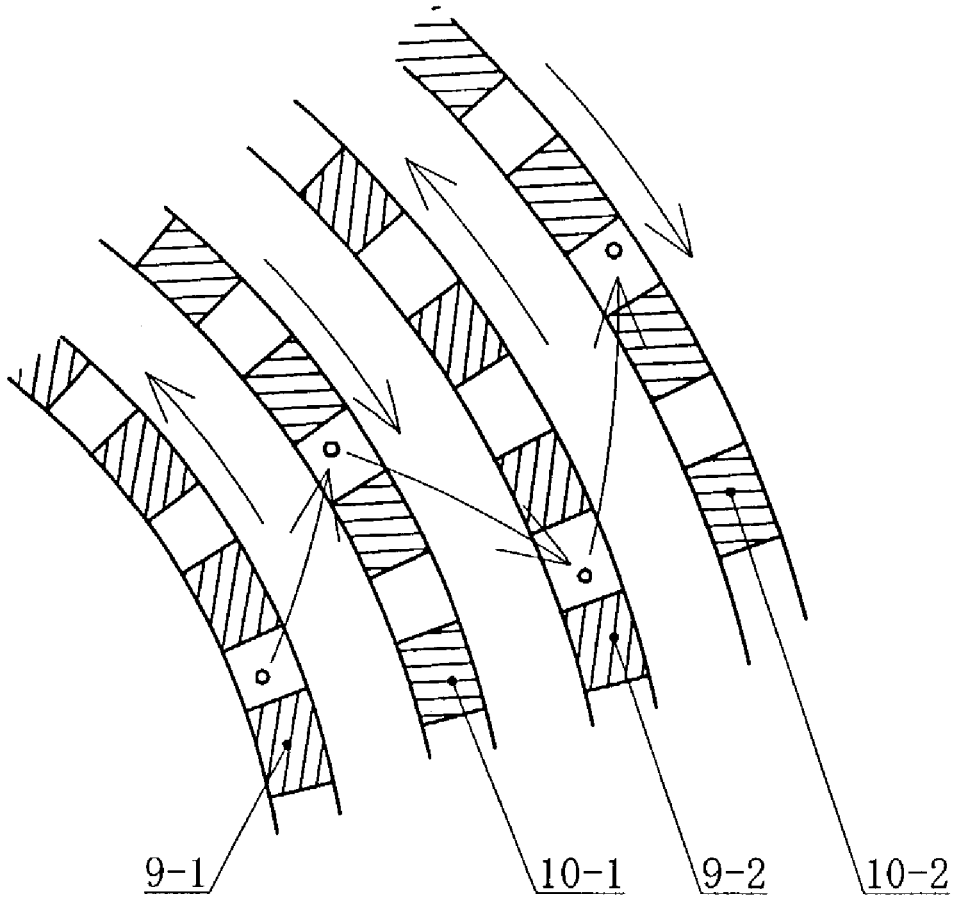
FIG. 3 is a diagram for explaining the fundamental operation and effect of the present invention.

After obtaining a high centrifugal force owing to the action of the blades 9-1 of the first rotary impeller 9 rotated in a positive (or negative) direction, the liquid, semi-solid or solid material impacts, at high speed in the direction shown by the arrow in FIG. 3, onto the blades 10-1 of the second rotary impeller 10 which is rotated in a negative (or positive) direction. Thereby, the material to be treated is mixed and emulsified through pulverizing and fining, and then continues to impact on the next-stage blades 9-2 and 10-2, etc., under the action from the blades of the rotary impellers 9 and 10 rotated in opposite (negative and positive) directions. The process continues to go round, i.e. is repeated and begins again, in this way until the treated material reaches the discharge port 32. In other words, because the material to be treated is thrust in a first direction by action of the impeller blades 9-1 and 9-2, the impact force of the material is increased by coming into contact with impeller blades 10-1 and 10-2 which are rotated in a direction opposite to the blades 9-1 and 9-2.

Thus, the impact force applied to the material to be treated can be increased without requiring use of a motor having a higher rotational speed; that is, within the limit of the operating rotational speed of the motor used, the impact force applied to the material to be mixed and emulsified through pulverizing and fining can be increased.

What is claimed is:

1. An impact-type rotary fining, homogenizing and emulsifying device comprising:

a casing body positioned on a base;

a feed port positioned in said casing body;

a discharge port positioned in said casing body;

a power shaft disposed inside said casing body and equipped with rotary impellers, wherein said rotary impellers are disposed on said power shaft and include a first rotary impeller rotated in a positive direction and a second rotary impeller rotated in a negative direction, and wherein a terminal end portion of said power shaft is suspended in a cantilever fashion substantially centrally in said feed port such that materials can be fed into said feed port from a position in front of said terminal end portion of said power shaft, said terminal end portion of said power shaft being equipped with a feed impeller.

2. The impact-type rotary fining, homogenizing and emulsifying device according to claim 1, wherein said power shaft comprises a hollow power shaft member and a solid power shaft member disposed inside said hollow power shaft member, and wherein said first rotary impeller rotated in the positive direction and said second rotary impeller rotated in the negative direction are mounted respectively on said hollow power shaft member and said solid power shaft member.

3. The impact-type rotary fining, homogenizing and emulsifying device according to claim 2, wherein said feed impeller comprises a centrifugal pump impeller.

4. The impact-type rotary fining, homogenizing and emulsifying device according to claim 2, wherein said first rotary impeller rotated in the positive direction comprises a plurality of first rotary impellers, and said second rotary impeller rotated in the negative direction comprises a plurality of second rotary impellers.

5. The impact-type rotary fining, homogenizing and emulsifying device according to claim 4, wherein said plurality of first rotary impellers rotated in the positive direction and said plurality of second rotary impellers rotated in the negative direction are positioned in a staggered relationship with respect to each other in a radial direction on a common axis.

6. The impact-type rotary fining, homogenizing and emulsifying device according to claim 4, wherein said first rotary impeller and said second rotary impeller are each constructed of a multi-blade impeller structure.

7. The impact-type rotary fining, homogenizing and emulsifying device according to claim 4, wherein said first rotary impeller and said second rotary impeller are each constructed of a plurality of separate blade elements which are joined together to provide a multi-blade impeller structure.

8. The impact-type rotary fining, homogenizing and emulsifying device according to claim 1, wherein said first rotary impeller rotated in the positive direction comprises a plurality of first rotary impellers, and said second rotary impeller rotated in the negative direction comprises a plurality of second rotary impellers.

9. The impact-type rotary fining, homogenizing and emulsifying device according to claim 8, wherein said plurality of first rotary impellers rotated in the positive direction and said plurality of second rotary impellers rotated in the negative direction are positioned in a staggered relationship with respect to each other in a radial direction on a common axis.

10. The impact-type rotary fining, homogenizing and emulsifying device according to claim 8, wherein said first rotary impeller and said second rotary impeller are each constructed of a multi-blade impeller structure.

11. The impact-type rotary fining, homogenizing and emulsifying device according to claim 8, wherein said first rotary impeller and said second rotary impeller are each constructed of a plurality of separate blade elements which are joined together to provide a multi-blade impeller structure.

12. The impact-type rotary fining, homogenizing and emulsifying device according to claim 1, wherein said feed impeller comprises a centrifugal pump impeller.

13. The impact-type rotary fining, homogenizing and emulsifying device according to claim 1, wherein a central axis of said feed port is substantially parallel to an axis of said power shaft.

14. The impact-type rotary fining, homogenizing and emulsifying device according to claim 13, wherein said central axis of said feed port is coaxial with said axis of said power shaft.

* * * * *